US010756419B2

(12) United States Patent
Benza et al.

(10) Patent No.: US 10,756,419 B2
(45) Date of Patent: Aug. 25, 2020

(54) LASER INDUCED GRAPHENE/GRAPHITE ANTENNA

(71) Applicant: Savannah River Nuclear Solutions, LLC, Aiken, SC (US)

(72) Inventors: Donald W. Benza, Aiken, SC (US); Karl E. Harrar, Aiken, SC (US); Matthew D. Folsom, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 164 days.

(21) Appl. No.: 15/867,921

(22) Filed: Jan. 11, 2018

(65) Prior Publication Data

US 2019/0214715 A1 Jul. 11, 2019

(51) Int. Cl.

| | |
|---|---|
| ***H01Q 1/38*** | (2006.01) |
| ***H01Q 1/36*** | (2006.01) |
| ***H01Q 9/28*** | (2006.01) |

(52) U.S. Cl.

CPC ..... *H01Q 1/38* (2013.01); *H01Q 1/368* (2013.01); *H01Q 9/285* (2013.01)

(58) Field of Classification Search

CPC ..... H01Q 1/38; H01Q 1/368; H01Q 9/285
See application file for complete search history.

(56) References Cited

U.S. PATENT DOCUMENTS

| | | | | |
|---|---|---|---|---|
| 4,571,592 | A * | 2/1986 | Justice | H01P 7/08 343/767 |
| 5,856,807 | A * | 1/1999 | Davis | H01Q 1/242 343/702 |
| 6,061,589 | A | 5/2000 | Bridges et al. | |
| 6,124,831 | A * | 9/2000 | Rutkowski | H01Q 1/243 343/700 MS |
| 6,417,816 | B2 | 7/2002 | Sadler et al. | |
| 7,732,002 | B2 | 6/2010 | Kodas et al. | |
| 8,808,810 | B2 | 8/2014 | Veerasamy | |
| 2003/0090421 | A1* | 5/2003 | Sajadinia | H01Q 1/243 343/700 MS |
| 2003/0164798 | A1* | 9/2003 | Nevermann | H01Q 1/243 343/700 MS |

(Continued)

FOREIGN PATENT DOCUMENTS

| | | |
|---|---|---|
| CN | 103811862 | 5/2014 |
| CN | 104916732 | 9/2015 |
| CN | 104134870 | 6/2017 |

OTHER PUBLICATIONS

Zhang, et al. "Investigation on Reconfigurable THz Bowtie Antenna." 2015 IEEE 4th Asia-Pacific Conference on Antennas and Propagation (APCAP).

(Continued)

*Primary Examiner* — Hoang V Nguyen
(74) *Attorney, Agent, or Firm* — Dority & Manning, P.A.

(57) ABSTRACT

The present disclosure is directed to an antenna that includes a substrate and a graphene or graphite layer positioned on at least a portion of the substrate. The graphene or graphite layer includes a first zone having a first thickness along a vertical direction of the antenna and a second zone having a second thickness along the vertical direction of the antenna. The second thickness is less than the first thickness such that the second zone has a greater electrical resistance than the first zone.

11 Claims, 7 Drawing Sheets

(56) References Cited

U.S. PATENT DOCUMENTS

2015/0369660 A1 12/2015 Yu
2017/0062821 A1* 3/2017 Tour ..... H01G 11/36

OTHER PUBLICATIONS

Lovine, et al. "Gmphene Bow-tie Nanoantenna for Wireless Communications in the Terahertz Band." NANOCOM'14, May 13-14 2014, Atlanta, GA, USA.
Koroth, et al. "Improving the detectability and imaging capability of ground penetrating radar using novel antenna concepts." Geophysical Research Abstracts. vol. 19, EGU2017-7562, 2017.
Ali, et al. "Ultra-Wideband Antenna Design for GPR Applications: A Review." IJACSA. vol. 8, No. 7, 2017, 392-400.
Lin, et al. "Laser-induced porous graphene films from commercial polymers." Nature Communications 5:5714 DOI: 10.1038.
Perruisseau-Carrier, Julien. "Graphene for Antenna Applications: Opportunities and Challenges from Microwaves to THz." 2012 Loughborough Antennas & Propagation Conference. 13-13 Nov. 2012.
Zhou, et al. "Miniaturized Tunable Terahertz Antenna Based on Graphene." Microwave and Optical Technology Letters. vol. 56, No. 8, Aug. 2014.
Nayak, et al. "Design and Simulation of Compact UWB Bow-tie Antenna with Reduced End-fire Reflections for GPR Applications." IEEE WiSPNET 2016 conference.
Rice University. "Defects are perfect in laser-induced graphene." https://phys.org/news/2014-12-defects-laser-induced-graphene-html.
Correas-Serrano, Diego, et al. "Graphene-based Antennas for Terahertz Systems: A Review." Forum for Electromagnetic Research Methods and Application Technologies.
Butrym, et al. "Resistive Loading that Does not Reduce Performance of a Pulse Antenna." Electromagnetic Phenomena, vol. 7, No. 1 (18), 20017, 164-169.

* cited by examiner

LASER INDUCED GRAPHENE/GRAPHITE ANTENNA

FEDERAL RESEARCH STATEMENT

This invention was made with Government support under Contract No. DE-AC09-08SR22470, awarded by the U.S. Department of Energy. The Government has certain rights in the invention.

FIELD OF THE INVENTION

The present disclosure generally relates to antennas, such as antennas suitable for use in ground-penetrating radar systems. More particularly, the present disclosure relates to antennas having a graphene or graphite conductive layer.

BACKGROUND OF THE INVENTION

A ground-penetrating radar system uses high frequency radio wave pulses to detect various objects (e.g., pipes, utilities, etc.) and/or conditions (e.g., bedrock, groundwater, etc.) within the ground. More specifically, the ground-penetrating radar system emits radio wave pulses into the ground. These radio wave pulses are reflected by the underground objects or conditions. The ground-penetrating radar system then receives the reflected radio wave pulses and is able detect or identify the objects or anomalies based on the characteristics of the reflected radio wave pulses.

To emit and receive the radio wave pulses, the ground-penetrating radar system includes an antenna. In general, the antenna must have a low reflected energy. However, this low reflected energy causes ringing in the antenna after the radio wave pulse is emitted. Specifically, ringing occurs in the antenna when electric currents reverberate between a central feed portion of the antenna and an outer tip of the antenna. In this respect, ringing may mask the reflected radio wave pulses received by the antenna by causing the emission of unwanted radio wave pulses from the antenna. In certain instances, resistors may be added to the antenna at various positions to reduce ringing. However, this uneven resistive loading of the antenna reduces the efficiency of the antenna, thereby increasing its power consumption.

Accordingly, an improved antenna, such as an antenna suitable for use in a ground-penetrating radar system, would be welcomed in the art.

BRIEF DESCRIPTION OF THE INVENTION

In one aspect, the present disclosure is directed to an antenna extending along a longitudinal direction between a first longitudinal end and a second longitudinal end, along a transverse direction between a first transverse end and a second transverse end, and along a vertical direction from a top end to a bottom end. The antenna includes a substrate and a graphene or graphite layer positioned on at least a portion of the substrate. The graphene or graphite layer includes a first zone having a first thickness along the vertical direction and a second zone having a second thickness along the vertical direction. The second thickness is less than the first thickness such that the second zone has a greater electrical resistance than the first zone.

In another aspect, the present disclosure is directed to a method for forming an antenna. The antenna extends along a longitudinal direction between a first longitudinal end and a second longitudinal end and along a vertical direction between a first vertical end and a second vertical end. The method includes forming a substrate at least partially from a polyimide. The method also includes moving a laser along at least a portion of the substrate to form a graphene or graphite layer on the substrate, with a parameter of the laser being indicative of a thickness of the graphene or graphite layer along the vertical direction. Furthermore, the method includes changing the parameter of the laser as the laser moves relative to the substrate such the graphene or graphite layer includes a first zone having a first thickness along the vertical direction and a second zone having a second thickness along the vertical direction. The second thickness is less than the first thickness such that the second zone has a greater electrical resistance than the first zone.

BRIEF DESCRIPTION OF THE FIGURES

A full and enabling disclosure of the present invention, including the best mode thereof, directed to one of ordinary skill in the art, is set forth in the specification, which makes reference to the appended figure, in which.

DETAILED DESCRIPTION

It is to be understood by one of ordinary skill in the art that the present discussion is a description of exemplary embodiments only, and is not intended as limiting the broader aspects of the present disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
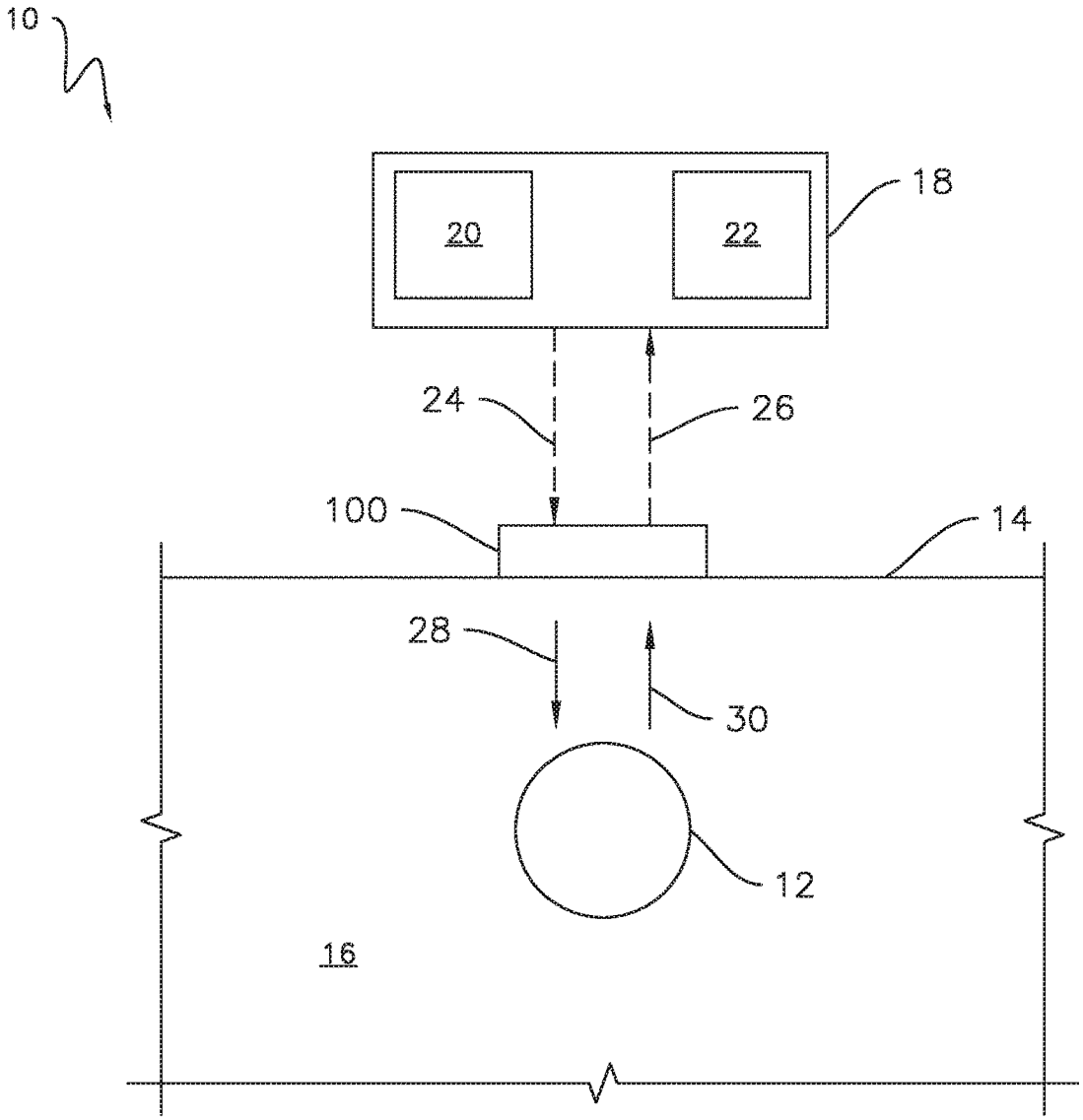
FIG. 1 illustrates a schematic view of an exemplary ground-penetrating radar system in accordance with aspects of the present disclosure.

Referring now to the drawings, FIG. 1 illustrates a schematic view of an exemplary ground penetrating radar system 10 in accordance with aspects of the present disclosure. In general, the system 10 may be configured to use radio wave pulses to detect the presence of various objects, such as a pipe 12, under a ground surface 14 or otherwise within soil 16. Although, the system 10 may also be configured to detect the presence of any other suitable object (e.g., other utilities, artifacts, etc.) and/or condition (e.g., bedrock, groundwater, ice, etc.) under the ground surface 14 and/or within the soil 16.

As shown, the system 10 includes a controller 18. In general, the controller 18 may correspond to any suitable processor-based device, including one or more computing devices. For example, the controller 18 may include one or more processors 20 and one or more associated memory devices 22 configured to perform a variety of computer-implemented functions (e.g., performing the methods, steps, calculations, and the like disclosed herein). As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory device(s) 22 may generally include memory element(s) including, but not limited to, a computer readable medium (e.g., random access memory (RAM)), a computer readable non-volatile medium (e.g., flash memory), a compact disc-read only memory (CD-ROM), a magneto-optical disk (MOD), a digital versatile disc (DVD), and/or other suitable memory elements or combinations thereof. The memory device(s) 22 may store instructions that, when executed by the processor 20, cause the processor 20 to perform various functions.

The system 10 also includes an antenna 100 communicatively coupled, such as electrically coupled, to the controller 18. In this respect, the controller 18 may be configured to transmit electric signals (e.g., as indicated by arrow 24) to the antenna 100. The antenna 100 may then be configured to convert these electric signals 24 into radio waves, which the antenna 100 then emits from the system 10. Similarly, the antenna 100 may also be configured to the receive radio waves from outside of the system 10, such as from the soil 16. The antenna 100 may, in turn, be configured to convert the received radio waves into electric signals (e.g., as indicated by arrow 26), which are then transmitted to the controller 18. In the embodiment shown in FIG. 1, the system 10 includes one antenna 100 that both emits and receives radio waves. However, in alternative embodiments, the system 10 may include one antenna 100 for emitting radio waves and another antenna 100 for receiving radio waves. In further embodiments, the system 10 may include any other suitable number or arrangement of antennas, including antennas of conventional construction.

As indicated above, the system 10 uses radio waves to detect objects or conditions under the ground surface 14 or otherwise within the soil 16, such as the illustrated pipe 12. More specifically, upon receipt of the electric signal 24, the antenna 100 emits a radio wave pulse (e.g., as indicated by 28) into the soil 16. The emitted radio wave pulse 28 moves through the soil 16 until it contacts the pipe 12. The radio wave pulse 28 is reflected off of the pipe 12 as a reflected radio wave pulse (e.g., as indicated by arrow 30). The antenna 100 is then configured to receive the reflected radio wave pulse 30 and convert the reflected radio wave pulse 30 into the electric signal 26. After receiving the electric signal 26, the controller 18 is configured to detect or otherwise identify the presence of the pipe 12. For example, in one embodiment, a time period between when the controller 18 transmits the signal 24 and receives the signal 26 may be indicative of the depth of the pipe 12 below the ground surface 14. However, in alternative embodiments, the controller 18 may be configured to detect or otherwise identify the presence of the pipe 12 based on any other suitable characteristic of the signals 24, 26 and/or radio wave pulses 28, 30.

The configuration of the ground-penetrating radar system 10 described above and shown in FIG. 1 is provided only to place the present subject matter in an exemplary field of use. Thus, the present subject matter may be readily adaptable to any manner of ground-penetrating radar system configuration.

Figure 2:
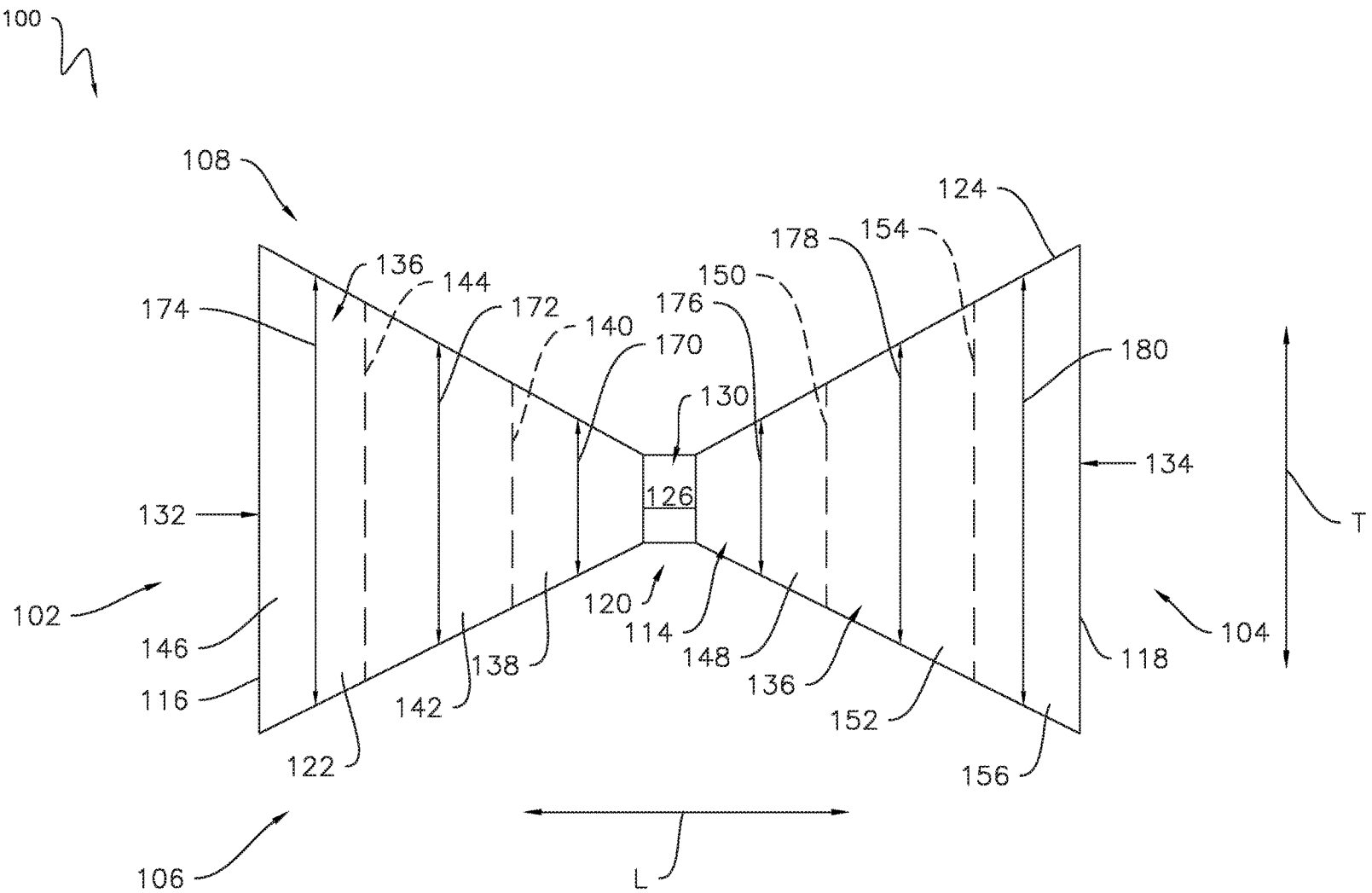
FIG. 2 illustrates a top view of one embodiment of an antenna suitable for use in a ground-penetrating radar system in accordance with aspects of the present disclosure.
Figure 3:
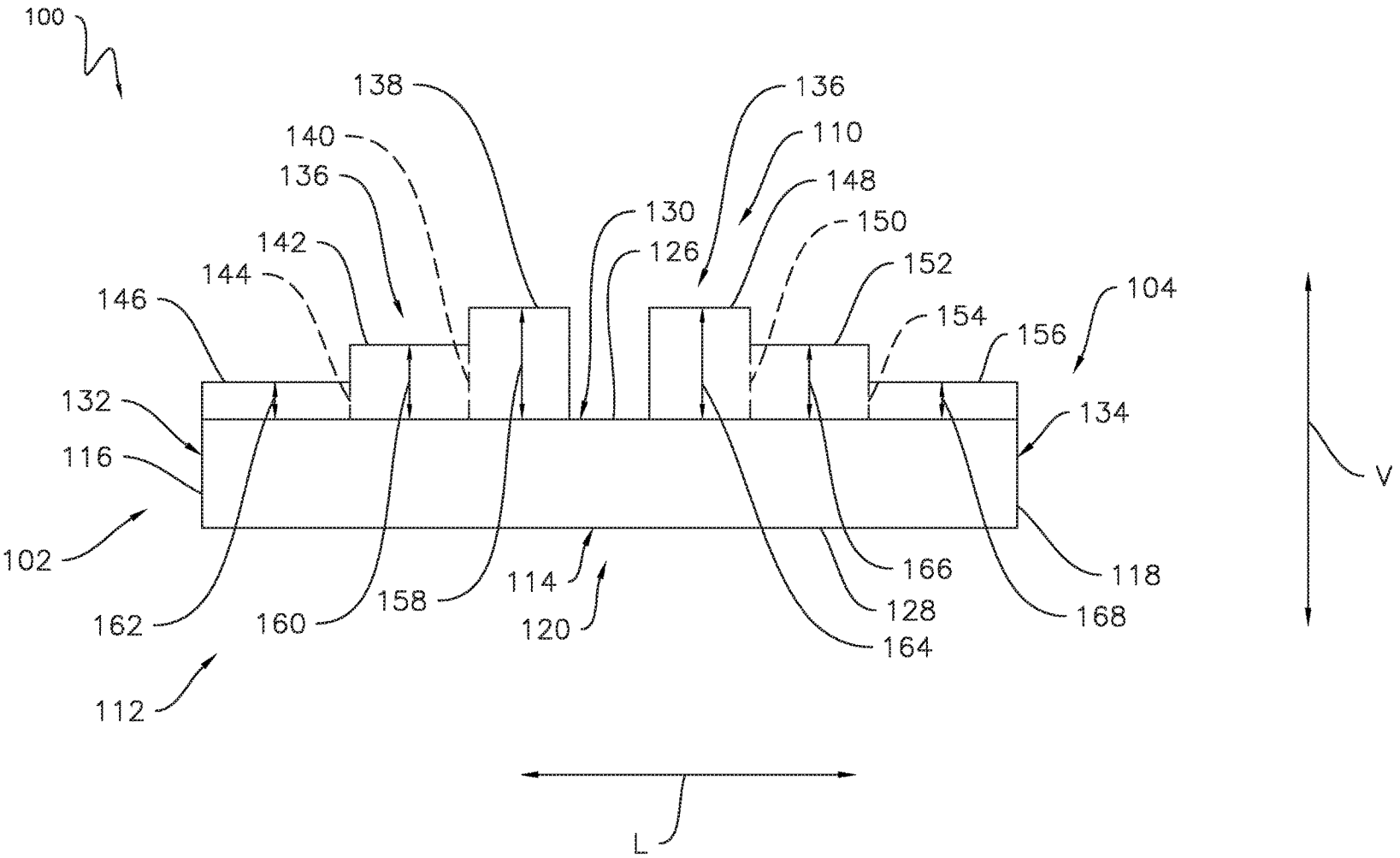
FIG. 3 illustrates a side view of the antenna shown in FIG. 2 in accordance with aspects of the present disclosure.

FIGS. 2 and 3 illustrate various views of one embodiment of an antenna 100. In general, the antenna 100 is configured or otherwise suitable for use in ground-penetrating radar system, such as the system 10. As such, the antenna 100 will be described herein with reference to the system 10 described above with reference to FIG. 1. However, the disclosed antenna 100 may generally be used with ground-penetrating radar systems having any other suitable configuration. Furthermore, the antenna 100 may be used in any other suitable application, including applications outside of ground penetrating radar systems.

In general, the antenna 100 may define a longitudinal direction L, a transverse direction T orthogonal to the longitudinal direction L, and a vertical direction V orthogonal to the longitudinal direction L and the transverse direction T. More specifically, the antenna 100 may extend along the longitudinal direction L between a first longitudinal end 102 and a second longitudinal end 104. The antenna 100 may also extend along the transverse direction T between a first transverse end 106 and a second transverse end 108. Furthermore, the antenna 100 may extend along the vertical direction V from a top end 110 to a bottom end 112.

The antenna 100 includes a substrate 114. As shown, the substrate 114 extends along the longitudinal direction L from a first longitudinal edge 116 positioned proximate to the first longitudinal end 102 to a second longitudinal edge 118 positioned proximate to the second longitudinal end 104. In this respect, the substrate 114 includes a longitudinally central region 120 located centrally along the longitudinal direction L between the first longitudinal edge 116 and a second longitudinal edge 118. The substrate 114 also extends along the transverse direction T from a first transverse edge 122 positioned proximate to the first transverse end 106 to a second transverse edge 124 positioned proximate to the second transverse end 108. Furthermore, the substrate 114 extends along the vertical direction V from a top surface 126 positioned proximate to the top end 110 to a bottom surface 128 positioned proximate to the bottom end 112. As will be described in greater detail below, the substrate 114 may be at least partially formed from polyimide. The particular construction of the substrate 114 will be described in greater detail below.

In the illustrated embodiment, the substrate 114 defines a bow-tie configuration. More specifically, the substrate 114 may include a common feed portion 130 positioned at or proximate to the longitudinally central region 120. The common feed portion 130 is shown as having a generally rectangular shape. Although, the common feed portion 130 may have any suitable shape in alternative embodiments. In one embodiment, the common feed portion 130 may include a conductive pad (not shown), such as a copper pad, to which wires (not shown) may be soldered to electrically couple the antenna 100 and the controller 18 (FIG. 1). Furthermore, the substrate 114 may also include first and second flared portions 132, 134. In general, the first flared portion 132 extends along the longitudinal direction L from the common feed portion 130 to the first longitudinal edge 116. Similarly, the second flared portion 134 extends along the longitudinal direction L from the common feed portion 130 to the second longitudinal edge 118. As shown, the width of the first and second flared portions 132, 134 increases in the transverse direction T as the first and second flared portions 132, 134 extend from the common feed portion 130 to corresponding longitudinal edge 116, 118. However, in alternative embodiments, the substrate 114 may define any other suitable configuration.

The antenna 100 also includes a graphene or graphite layer 136 positioned on at least a portion of the top surface 126 of the substrate 114. As shown, the layer 136 is positioned on the first and second flared portions 132, 134 of the substrate 114. However, in alternative embodiments, the layer 136 may also be positioned on at least a portion of the bottom surface 128 in addition to or in lieu of the top surface 126. Furthermore, in some embodiments, the layer 136 may be positioned on only one of the first and second flared portions 132, 134. In fact, the layer 136 may be positioned on any other suitable portion of the substrate 136. As will be described in greater detail below, the layer 136 may be a laser-induced graphene or graphite layer.

The layer 136 includes various zones. For example, the layer 136 includes a first zone 138 extending along the longitudinal direction L from the common feed portion 130 to dashed line 140. The layer 136 also includes a second zone 142 extending along the longitudinal direction L from the first zone 138 (i.e., dashed line 140) to dashed line 144. The layer 136 further includes a third zone 146 extending along the longitudinal direction L from the second zone 142 (i.e., dashed line 144) to the first longitudinal edge 116. Moreover, the layer 136 includes a fourth zone 148 extending along the longitudinal direction L from the common feed portion 130 to dashed line 150. Furthermore, the layer 136 includes a fifth zone 152 extending along the longitudinal direction L from the fourth zone 148 (i.e., dashed line 150) to dashed line 154. Additionally, the layer 136 includes a sixth zone 156 extending along the longitudinal direction L from the fifth zone 152 (i.e., dashed line 154) to the second longitudinal edge 118. In the embodiment shown, the first, second, and third zones 138, 142, 146 are positioned on the first flared portion 132 of the substrate 114, and the fourth, fifth, and sixth zones 148, 152, 156 are positioned on the second flared portion 134. In alternative embodiments, the layer 136 may include more or fewer zones so long as the layer 136 includes at least two zones. Moreover, the zones may be positioned in any suitable location on the substrate 114.

As shown in FIG. 3, the zones 138, 142, 146, 148, 152, 156 may generally define varying thicknesses along the vertical direction V. More specifically, the first, second, third, fourth, fifth, and sixth zones 138, 142, 146, 148, 152, 156 may respectively define a first, second, third, fourth, fifth, and sixth thicknesses 158, 160, 162, 164, 166, 168 along the vertical direction V. In the illustrated embodiment, the first thickness 158 is greater than the second thickness 160, and the second thickness 160 is greater than the third thickness 162. Similarly, the fourth thickness 164 is greater than the fifth thickness 166, and the fifth thickness 166 is greater than the sixth thickness 168. Furthermore, the first and fourth thicknesses 158, 164 may be the same or substantially the same (within five percent), the second and fifth thicknesses 160, 166 may be the same or substantially the same (within five percent), and the third and sixth thicknesses 162, 168 may be the same or substantially the same (within five percent). However, in alternative embodiments, the zones 138, 142, 146, 148, 152, 156 may have any suitable thicknesses along the vertical direction V so long as at least two of the zones 138, 142, 146, 148, 152, 156 have different thicknesses.

The layer 136 is electrically conductive, thereby permitting the antenna 100 to emit and/or receive radio waves. The electrical conductivity of the layer 136 is based on the thickness of the layer 136 along the vertical direction V. That is, the greater the thickness of the layer 136, the less electrical resistance the layer 136 has. As such, in the illustrated embodiment, the third zone 146 has a greater electrical resistance than the second zone 142, and the second zone 142 has a greater electrical resistance than the first zone 138. Similarly, the sixth zone 156 has a greater electrical resistance than the fifth zone 152, and the fifth zone 152 has a greater electrical resistance than the fourth zone 148. Furthermore, the first and fourth zones 138, 148 may have the same or substantially the same (within five percent) electrical resistances, the second and fifth thicknesses 160, 166 may have the same or substantially the same (within five percent) electrical resistances, and the third and sixth thicknesses 162, 168 may have the same or substantially the same (within five percent) electrical resistances. However, in alternative embodiments, the zones 138, 142, 146, 148, 152, 156 may have any suitable electrical resistances so long as at least two of the zones 138, 142, 146, 148, 152, 156 have different electrical resistances.

Additionally, as shown in FIG. 2, the width of zones 138, 142, 146, 148, 152, 156 in the transverse direction T may also differ. More specifically, the first, second, third, fourth, fifth, and sixth zones 138, 142, 146, 148, 152, 156 may respectively define a first, second, third, fourth, fifth, and sixth widths 170, 172, 174, 176, 178, 180 in the transverse direction T. In the illustrated embodiment, the third width 174 is greater than the second width 172, and the second width 172 is greater than the first width 170. Similarly, the sixth width 180 is greater than the fifth width 178, and the fifth width 178 is greater than the third width 176. Furthermore, the first and fourth widths 170, 176 may be the same, the second and fifth widths 172, 178 may be the same, and the third and sixth widths 174, 180 may be the same. Furthermore, given the bow-tie configuration of the antenna 100, the transverse widths in each zone 138, 142, 146, 148, 152, 156 may vary along the longitudinal direction L. However, in alternative embodiments, the zones 138, 142, 146, 148, 152, 156 may have any suitable widths in the transverse direction T.

Figure 4:
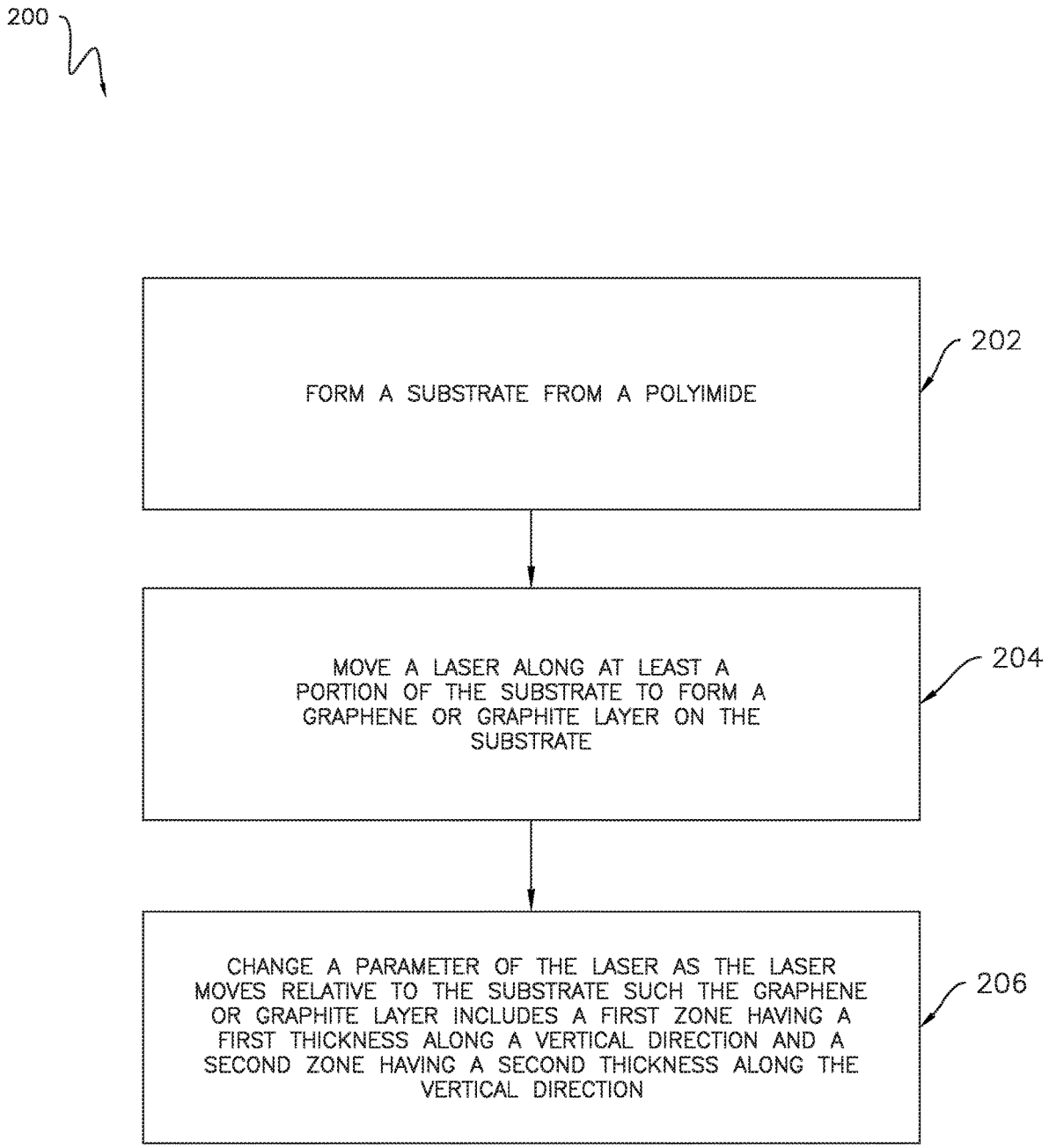
FIG. 4 is a flow chart illustrating one embodiment of a method for forming an antenna in accordance with aspects of the present disclosure.

FIG. 4 illustrates one embodiment of a method 200 for forming an antenna in accordance with aspects of the present subject matter. Although FIG. 4 depicts steps performed in a particular order for purposes of illustration and discussion, the methods discussed herein are not limited to any particular order or arrangement. As such, the various steps of the methods disclosed herein can be omitted, rearranged, combined, and/or adapted in various ways without deviating from the scope of the present disclosure.

Figure 5:
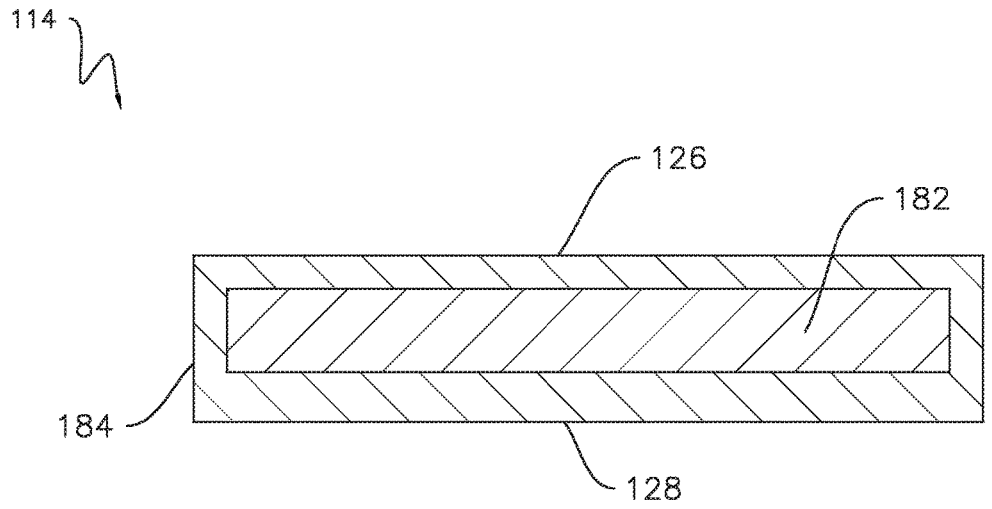
FIG. 5 illustrates a cross-sectional view of one embodiment of a substrate for use in forming an antenna in accordance with aspects of the present disclosure.
Figure 6:
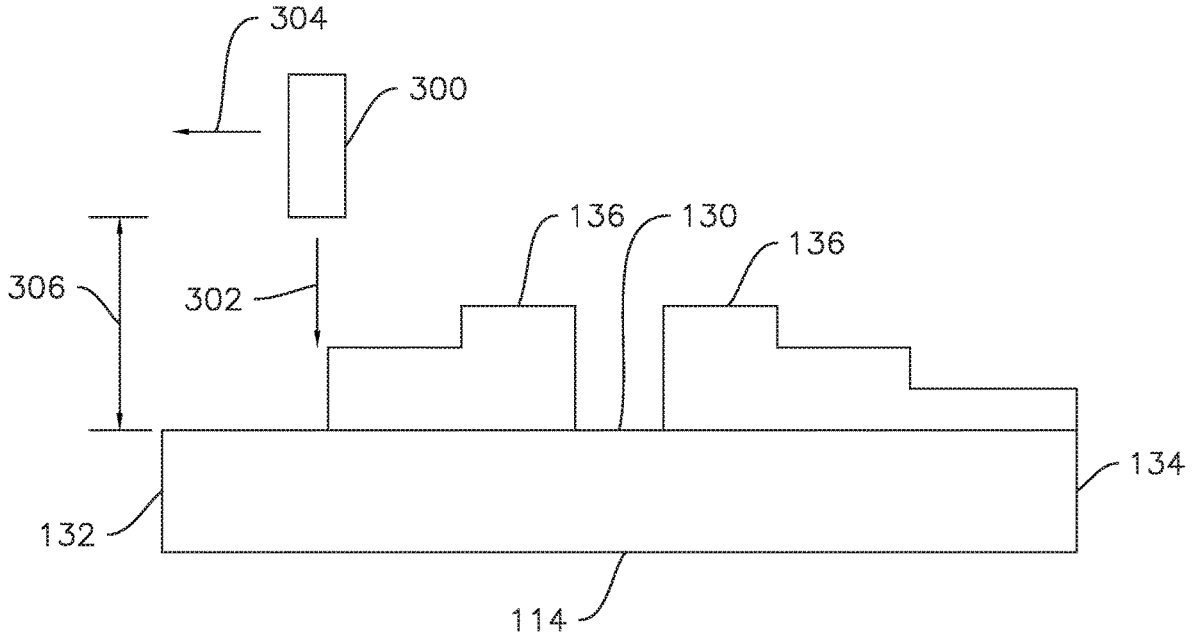
FIG. 6 illustrates a side view of one embodiment of a laser forming a graphene or graphite layer of an antenna on a substrate of the antenna in accordance with aspects of the present disclosure.

As shown in FIG. 4, at (202), the method 200 includes forming a substrate at least partially from a polyimide. For example, as mentioned above, the substrate 114 may be formed at least partially from a polyimide material. As illustrated in FIG. 5, the substrate 114 may be formed by wrapping a polyimide material 182, such as a polyimide cloth, around a backing 184, such as a card stock backing. However, in alternative embodiments, the substrate 114 may have any other suitable construction. Additionally, as mentioned above, in several embodiments, the substrate 114 may be formed such that it defines a bow-tie configuration. Although, the substrate 114 may be formed with any other suitable configuration in other embodiments.

Moreover, as shown in FIG. 4, at (204), the method 200 includes moving a laser along at least a portion of the substrate to form a graphene or graphite layer on the substrate. Referring now to FIG. 5, a laser 300 may be configured to emit a laser beam (e.g., as indicated by arrow 302) directed at the substrate 114 such that the laser beam 302 contacts a portion of the polyimide material 182 of the substrate 114. In this respect, the laser beam 302 burns the polyimide material 182, thereby forming a portion of the graphene or graphite layer 136 on the substrate 114. In such embodiments, the layer 136 is a laser-induced graphene or graphite layer. The laser 300 is then moved relative to the substrate 114, such as in a movement direction (e.g., as indicated by arrow 304), to form the additional portions of the layer 136. In one embodiment, the laser beam 302 is a blue laser beam.

Various parameters of the laser 300 and/or laser beam 302 may be indicative of the thickness of the layer 136 along the vertical direction V. More specifically, a speed with which the laser 300 moves relative to the substrate 114 may be indicative of the thickness of the layer 136. For example, the thickness of the layer 136 may increase as the speed with which the laser 300 moves relative to the substrate 114 decreases. An intensity of the laser beam 302 may also be indicative of the thickness of the layer 136. For example, the thickness of the layer 136 may increase as the intensity of the laser beam 302 increases. Furthermore, a distance 306 between the laser 300 and the substrate 114 may be indicative of the thickness of the layer 136. For example, the thickness of the layer 136 may increase as the distance 306 between the laser 300 and the substrate 114 decreases.

Additionally, as shown in FIG. 4, at (206), the method 200 includes changing a parameter of the laser or laser beam as the laser moves relative to the substrate such that the graphene or graphite layer includes a first zone having a first thickness along a vertical direction and a second zone having a second thickness along the vertical direction. More specifically, as described above, the layer 136 includes several zones 138, 142, 146, 148, 152, 156 having various corresponding thicknesses 158, 160, 162, 164, 166, 168. These varying thicknesses 158, 160, 162, 164, 166, 168, in turn, provide the corresponding zone 138, 142, 146, 148, 152, 156 with varying electrical resistances. In this respect, as the laser 300 is moved relative to substrate 114 when forming the layer 136, a parameter of the laser 300 and/or the laser beam 302 may be varied to create the thicknesses 158, 160, 162, 164, 166, 168 of the corresponding zone 138, 142, 146, 148, 152, 156. For example, as mentioned above, the thickness 158 of the first zone 138 is greater than the thickness 160 of the second zone 142. As such, when the laser 300 moves from the first zone 138 to the second zone 142, the parameter of the laser 300 and/or the laser beam 302 is modified or adjusted in such a manner that the laser 300 forms a thinner layer of graphene or graphite.

Figure 7:
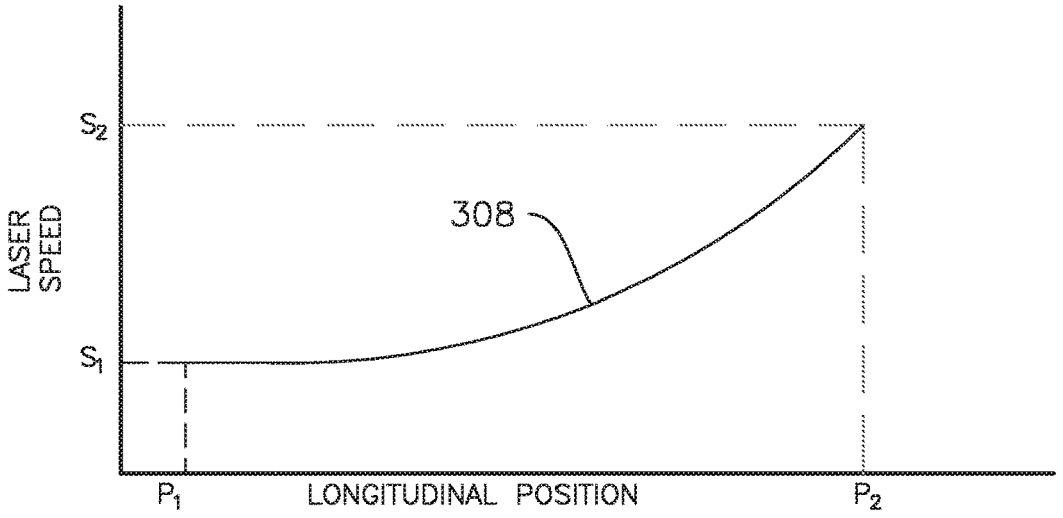
FIG. 7 is an exemplary graph illustrating a change in a speed of a laser relative to a substrate of an antenna based on a longitudinal position along the antenna during formation of the antenna in accordance with aspects of the present disclosure.

In one embodiment, the speed with which the laser 300 moves relative to the substrate 114 may be modified or adjusted to form the zones 138, 142, 146, 148, 152, 156. For example, referring now to FIG. 7, the speed with which the laser 300 moves relative to the substrate 114 may be modified based on a position of the laser 300 along the longitudinal direction L. In this respect, and as shown, the speed of the laser 300 relative to the substrate 114 may be increased along a curve 308 from a speed $S_1$ to a speed $S_2$ as the laser 300 moves from a position $P_1$ (e.g., a position within the first zone 138) along the longitudinal direction L to a position $P_2$ (e.g., a position within the second zone 142) along the longitudinal direction L. However, in alternative embodiments, the speed with which the laser 300 moves relative to the substrate 114 may be modified or adjusted in any other suitable manner.

Figure 8:
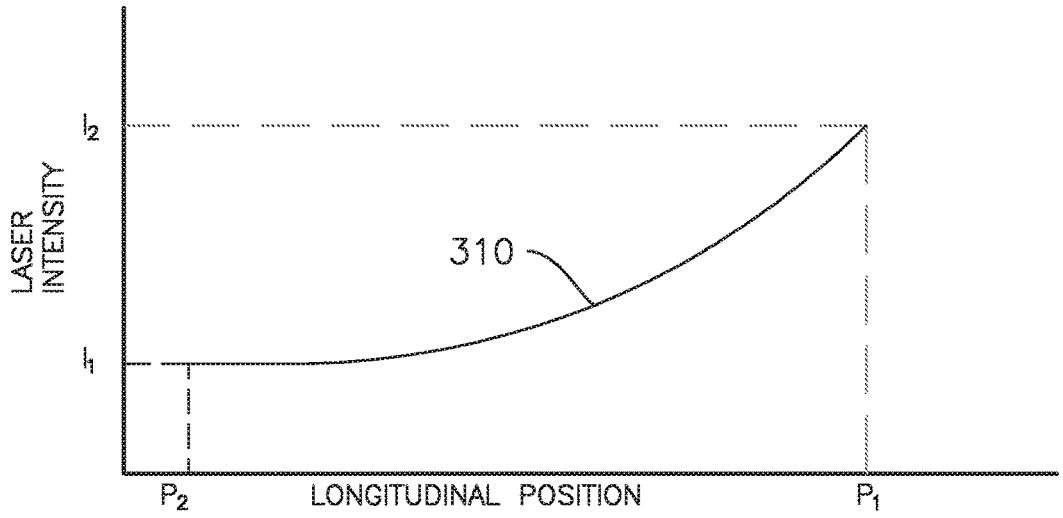
FIG. 8 is an exemplary graph illustrating a change in an intensity of a laser based on a longitudinal position along an antenna during formation of the antenna in accordance with aspects of the present disclosure.

In another embodiment, the intensity of the laser beam 302 may be modified or adjusted to form the zones 138, 142, 146, 148, 152, 156. For example, referring now to FIG. 8, the intensity of the laser beam 302 may be modified based on a position of the laser 300 along the longitudinal direction L. In this respect, and as shown, the intensity of the laser beam 302 may be increased along a curve 310 from an intensity $I_1$ to an intensity $I_2$ as the laser 300 moves from the position $P_2$ (e.g., the position within the second zone 142) along the longitudinal direction L to the position $P_1$ (e.g., the position within the first zone 138) along the longitudinal direction L. However, in alternative embodiments, the intensity of the laser beam 302 may be modified or adjusted in any other suitable manner.

Figure 9:
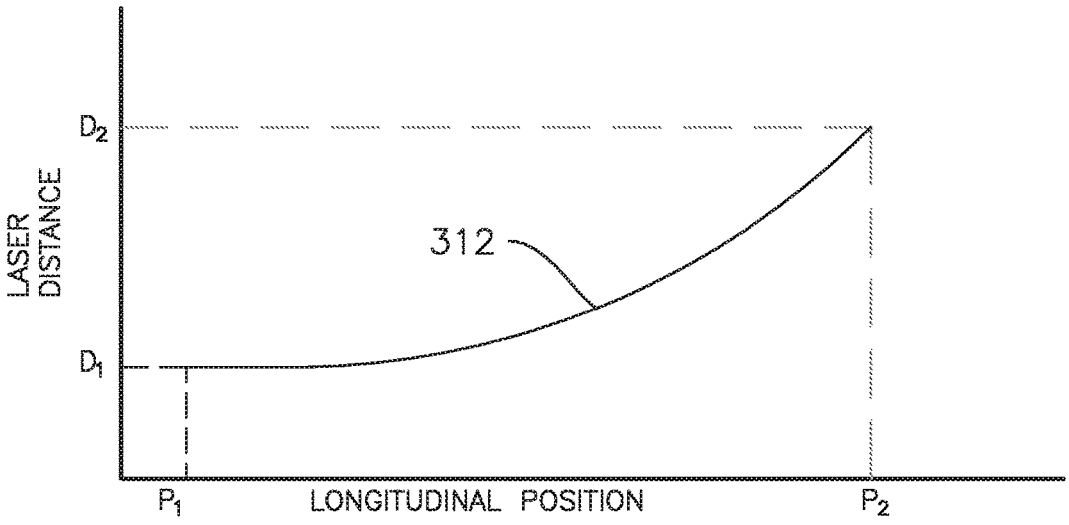
FIG. 9 is an exemplary graph illustrating a change in a distance between a laser and a substrate of an antenna based on a longitudinal position along the antenna during formation of the antenna in accordance with aspects of the present disclosure.

In a further embodiment, the distance 306 between the laser 300 and the substrate 114 may be modified or adjusted to form the zones 138, 142, 146, 148, 152, 156. For example, referring now to FIG. 9, the distance 306 between the laser 300 and the substrate 114 may be modified based on a position of the laser 300 along the longitudinal direction L. In this respect, and as shown, the distance 306 between the laser 300 and the substrate 114 may be increased along a curve 312 from a distance $D_1$ to a distance $D_2$ as the laser 300 moves from the position $P_1$ (e.g., the position within the first zone 138) along the longitudinal direction L to the position $P_2$ (e.g., the position within the second zone 142) along the longitudinal direction L. However, in alternative embodiments, the distance 306 between the laser 300 and the substrate 114 may be modified or adjusted in any other suitable manner. Furthermore, in certain embodiments, more than one parameter may be adjusted to from the various zones 138, 142, 146, 148, 152, 156.

Figure 10:
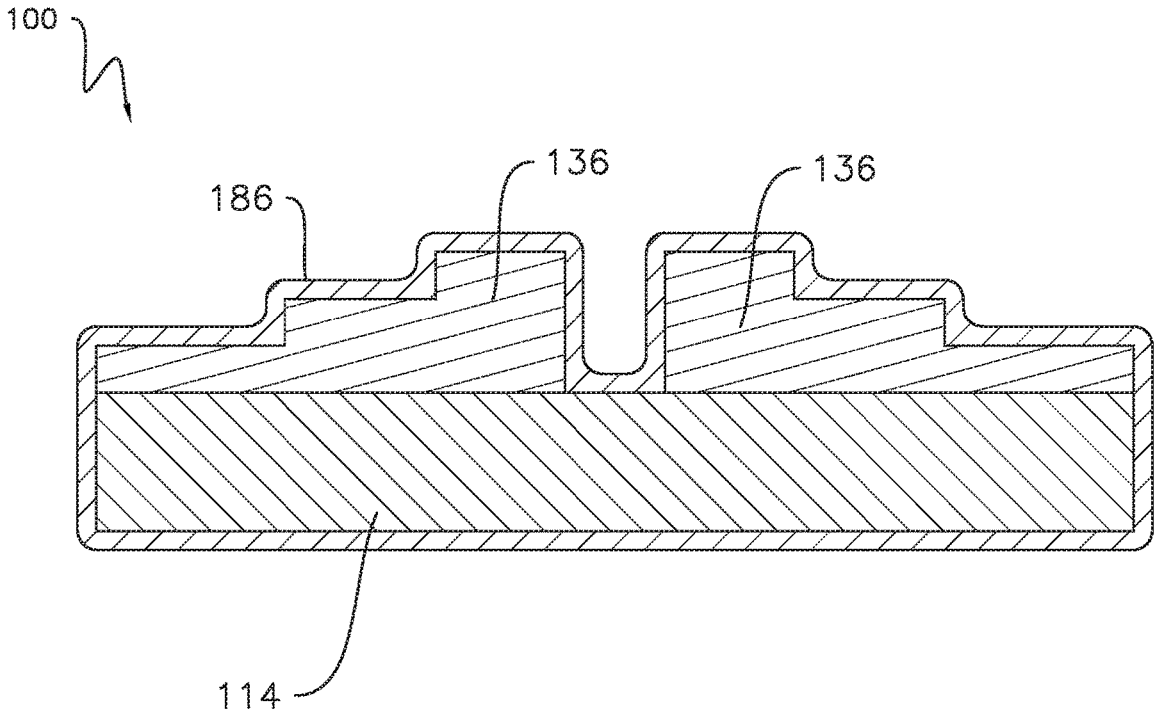
FIG. 10 illustrates a cross-sectional view of one embodiment of an antenna, illustrating the antenna being laminated with a polymeric material in accordance with aspects of the present subject matter.

Additionally, the method 200 may include laminating the substrate and the graphene or graphite layer with a polymeric material (e.g., polyethylene). For example, as shown in FIG. 10, the substrate 114 and the layer 136 may be laminated or otherwise encased with a polymeric material 186 (e.g., polyethylene) to protect the antenna 100 from moisture, dirt, contaminants, and/or the like.

As described in greater detail above, the disclosed antenna 100, unlike conventional antennas, includes a graphene or graphite layer having various zones, with at least two of these zones having different thicknesses. These differing thicknesses, in turn, provide different electrical conductivities to the antenna 100. As such, the antenna 100 produces less ringing than conventional antennas, while maintaining the efficiency thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An antenna extending along a longitudinal direction between a first longitudinal end and a second longitudinal end, along a transverse direction between a first transverse end and a second transverse end, and along a vertical direction from a top end to a bottom end, the antenna comprising:

a substrate; and an electrically conductive graphene or graphite layer positioned on at least a portion of the substrate, the electrically conductive graphene or graphite layer including a first zone having a first thickness along the vertical direction and a second zone having a second thickness along the vertical direction, the second thickness being less than the first thickness such that the second zone has a greater electrical resistance than the first zone.

2. The antenna of claim 1, wherein the substrate includes a common feed portion positioned at a central location along the longitudinal direction between the first and second longitudinal ends, the first zone being positioned closer to common feed portion than the second zone.

3. The antenna of claim 1, wherein the electrically conductive graphene or graphite layer comprises a third zone having a third thickness along the vertical direction and a fourth zone having a fourth thickness along the vertical direction, the third thickness being substantially the same as than the first thickness such that the third zone has substantially the same electrical resistance as the first zone, the fourth thickness being substantially the same as than the second thickness such that the fourth zone has substantially the same electrical resistance as the second zone.

4. The antenna of claim 1, wherein the first zone comprises a first width in the transverse direction and the second zone comprises a second width in the transverse direction, the second width being greater than the first width.

5. The antenna of claim 1, wherein the substrate comprises first and second flared portions spaced apart from each other along the longitudinal direction and a common feed portion positioned between the first and second flared portions along the longitudinal direction, the first and second zones being positioned on at least a portion of one of the first or second flared portions.

6. The antenna of claim 5, wherein the first and second zones are positioned on at least a portion of same one of the first or second flared portions.

7. The antenna of claim 5, wherein the first and second flared portions define a bow-tie shape.

8. The antenna of claim 1, wherein the substrate and the electrically conductive graphene or graphite layer are encased with a polymeric material.

9. The antenna of claim 1, wherein the electrically conductive graphene or graphite layer is a laser-induced graphene or graphite layer.

10. The antenna of claim 1, wherein the substrate is at least partially formed from a polyimide.

11. The antenna of claim 1, wherein the antenna is configured for use in a ground-penetrating radar system.

* * * * *